US010478688B1

(12) United States Patent
Stevens et al.

(10) Patent No.: US 10,478,688 B1
(45) Date of Patent: Nov. 19, 2019

(54) KNOB SLEEVE FOR A BALL BAT HANDLE ASSEMBLY

(71) Applicant: Wilson Sproting Goods Co., Chicago, IL (US)

(72) Inventors: Ryan D. Stevens, Rocklin, CA (US); Adam G. Gray, Roseville, CA (US); James M. Earley, Roseville, CA (US)

(73) Assignee: Wilson Sporting Goods Co, Chicago, IL (US)

( * ) Notice: Subject to any disclaimer, the term of this patent is extended or adjusted under 35 U.S.C. 154(b) by 0 days.

(21) Appl. No.: 16/124,850

(22) Filed: Sep. 7, 2018

(51) Int. Cl.

| | |
|---|---|
| ***A63B 60/06*** | (2015.01) |
| ***A63B 59/50*** | (2015.01) |
| ***A63B 60/10*** | (2015.01) |
| ***A63B 60/08*** | (2015.01) |
| *A63B 102/18* | (2015.01) |
| *A63B 59/58* | (2015.01) |
| *A63B 60/14* | (2015.01) |
| *A63B 60/12* | (2015.01) |

(52) U.S. Cl.
CPC ..... *A63B 60/10* (2015.10); *A63B 60/08* (2015.10); *A63B 59/50* (2015.10); *A63B 60/12* (2015.10); *A63B 60/14* (2015.10); *A63B 2059/581* (2015.10); *A63B 2102/18* (2015.10)

(58) Field of Classification Search
CPC ..... A63B 59/50; A63B 60/06; A63B 60/08; A63B 60/10; A63B 2102/18; A63B 60/14; A63B 60/12; A63B 2069/0008
USPC ..... 473/568, 457
See application file for complete search history.

(56) References Cited

U.S. PATENT DOCUMENTS

| | | | | |
|---|---|---|---|---|
| 1,026,990 | A | 5/1912 | Matson | |
| 3,469,839 | A * | 9/1969 | Pietronuto | A63B 60/00 473/564 |
| 3,697,069 | A | 10/1972 | Merola | |
| 5,409,214 | A | 4/1995 | Cook | |
| 5,482,270 | A * | 1/1996 | Smith | A63B 60/12 473/568 |
| 5,577,722 | A | 11/1996 | Glassberg | |
| 5,624,114 | A * | 4/1997 | Kelsey | A63B 60/10 473/520 |
| 5,674,138 | A | 10/1997 | Nolan | |
| D387,831 | S * | 12/1997 | George | D21/753 |
| 5,839,983 | A | 11/1998 | Kramer | |
| 6,234,924 | B1 * | 5/2001 | Washburn, Jr. | A63B 60/10 473/568 |
| 6,277,040 | B1 * | 8/2001 | Randolph | A63B 15/00 473/568 |
| 6,500,079 | B1 | 12/2002 | Tucker, Sr. | |

(Continued)

*Primary Examiner* — Mark S Graham
(74) *Attorney, Agent, or Firm* — Terence P. O'Brien

(57) ABSTRACT

A knob sleeve for a ball bat extending along a longitudinal axis and having a tubular handle portion and a knob attached to the handle portion. The knob sleeve includes a tubular body having a distal end and a proximal end. The body defines a central bore for receiving the handle portion. The body includes at least first and second regions positioned adjacent the distal and proximal ends of the body, respectively. The first and second regions have first and second maximum outside diameters, respectively. The second maximum outside diameter is greater than the first maximum outside diameter. Each of the first and second regions has a height measured with respect to the longitudinal axis of at least 0.4 inch.

23 Claims, 6 Drawing Sheets

(56) References Cited

U.S. PATENT DOCUMENTS

| | | | | |
|---|---|---|---|---|
| 6,869,373 | B1 | 3/2005 | Byrne et al. | |
| D521,092 | S * | 5/2006 | Morales | D21/725 |
| D523,105 | S * | 6/2006 | Bernacchi | D21/725 |
| 7,166,046 | B1 | 1/2007 | Liu | |
| 7,169,069 | B1 * | 1/2007 | Dalton | A63B 69/0002 473/568 |
| 7,744,497 | B2 | 6/2010 | Phelan, Jr. | |
| 7,878,930 | B2 | 2/2011 | Leinert | |
| 7,909,705 | B2 | 3/2011 | Gill et al. | |
| 8,052,547 | B2 | 11/2011 | Nusbaum et al. | |
| D655,771 | S | 3/2012 | Thompson et al. | |
| 8,167,744 | B2 * | 5/2012 | Silvain | A63B 60/10 473/457 |
| 8,425,353 | B2 | 4/2013 | Jones et al. | |
| D682,963 | S * | 5/2013 | McLeod | D21/753 |
| D697,153 | S * | 1/2014 | Fossum | D21/753 |
| 8,845,462 | B2 | 9/2014 | Chung | |
| D715,879 | S | 10/2014 | Goodwin et al. | |
| 8,944,943 | B2 * | 2/2015 | Heiberg | A63B 60/28 473/568 |
| 9,101,810 | B2 | 8/2015 | Carlson et al. | |
| 9,308,424 | B2 | 4/2016 | Thurman et al. | |
| D761,925 | S * | 7/2016 | Phelan, Jr. | D21/753 |
| 9,457,248 | B2 * | 10/2016 | Long | A63B 71/141 |
| 9,468,823 | B2 * | 10/2016 | Mitton | A63B 60/16 |
| 9,550,100 | B2 * | 1/2017 | Grady, Jr. | A63B 60/06 |
| 10,004,962 | B2 * | 6/2018 | Codd | A63B 60/24 |
| 2004/0162168 | A1 | 8/2004 | Ginkel | |
| 2004/0180739 | A1 * | 9/2004 | Kramer | A63B 60/10 473/568 |
| 2004/0224804 | A1 * | 11/2004 | Estape | A63B 60/10 473/568 |
| 2009/0312125 | A1 * | 12/2009 | Kearns | A63B 69/0002 473/451 |
| 2010/0151975 | A1 * | 6/2010 | Hisle | A63B 60/06 473/568 |
| 2017/0203171 | A1 | 7/2017 | Nardin | |

* cited by examiner

KNOB SLEEVE FOR A BALL BAT HANDLE ASSEMBLY

BACKGROUND OF THE INVENTION

Baseball and softball bats are well known sporting goods. Ball bats typically include a hitting or barrel portion for impacting a ball, a handle portion having a reduced diameter for gripping by the player, and an enlarged knob secured to a proximal end of the handle portion. Many young players enjoy and participate in the game of baseball or softball for several years as they grow. As a result of such growth, players often move from one bat size, weight and/or length of bat to another bat that is typically greater in length, weight and/or size. Upon transitioning from a smaller, shorter and/or lighter bat to a bat that is slightly longer and/or heavier, many younger players find the need to grip such bats further up the bat handle because by gripping the bat further up the handle, or choking-up, the bat can become easier to swing. "Choking-up" on the bat changes the effective length of the bat, and reduces the swing weight of the bat by altering the location of the pivoting of the bat during a swing.

In other situations, baseball and softball players of all ages and/or skill levels, may choose to "choke-up" on the bat for one or more of a variety of reasons, such as, to reduce the effective length of the bat, to reduce the swing weight of the bat making the bat easier to swing, and to decrease the time it takes for a player to bring a bat into the hitting zone.

One drawback of "choking-up" on a ball bat is that the player no longer benefits from the bulbous shape of the knob serving as a stop or bearing surface for the player's lower gripping hand, or the bulbous shape providing a surface of the player's hand grasp. As a result, many player's find the swing when choking-up to uncomfortable or undesirable primarily due to the lack of contact with the knob or inability to grasp the knob when swinging.

Accordingly several needs still exist in the ball bat industry. A need exists for a ball bat that can readily accommodate a player transitioning to a slightly longer, larger and/or heavier bat. What is needed is a bat that facilitates a player's ability to make such a transition to a longer, larger, and/or heavier bat. It would be advantageous to provide a ball bat that provides a player with the ability to contact an enlarged surface, such as a knob-like surface, while choking-up. It would be beneficial to provide such advantages in a manner that does not reduce the playability of the bat, or negatively affect the performance, feel and/or appearance of the bat. It would also be advantageous to provide an efficient, easy to use tool, system or method that would allow a player to choke-up or adjust the location of his or her grip during a season, game, or at-bat.

This invention will become more fully understood from the following detailed description, taken in conjunction with the accompanying drawings described herein below, and wherein like reference numerals refer to like parts.

DETAILED DESCRIPTION OF EXAMPLE IMPLEMENTATIONS

Figure 1:
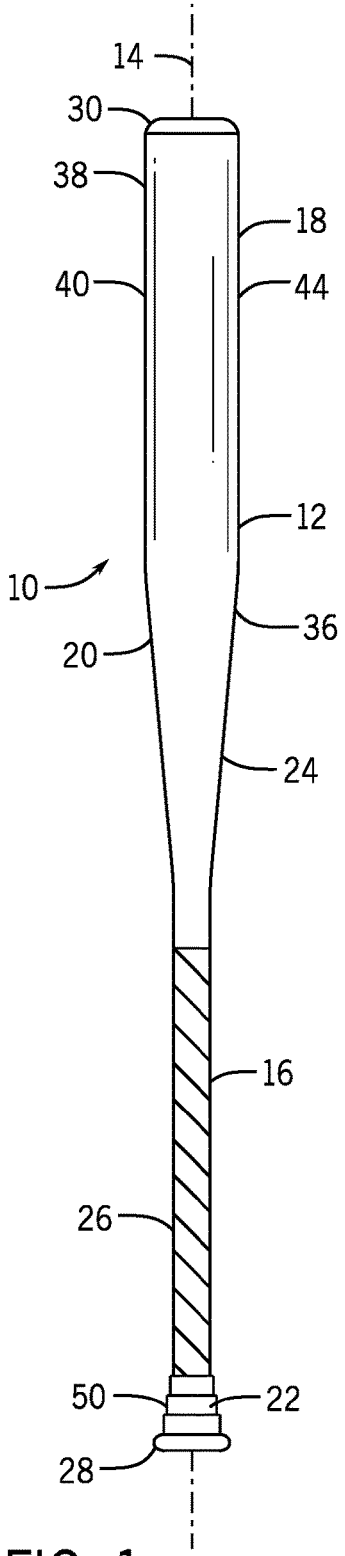
FIG. 1 is a side view of a ball bat including a knob sleeve in accordance with an example implementation of the present invention.
Figure 2:
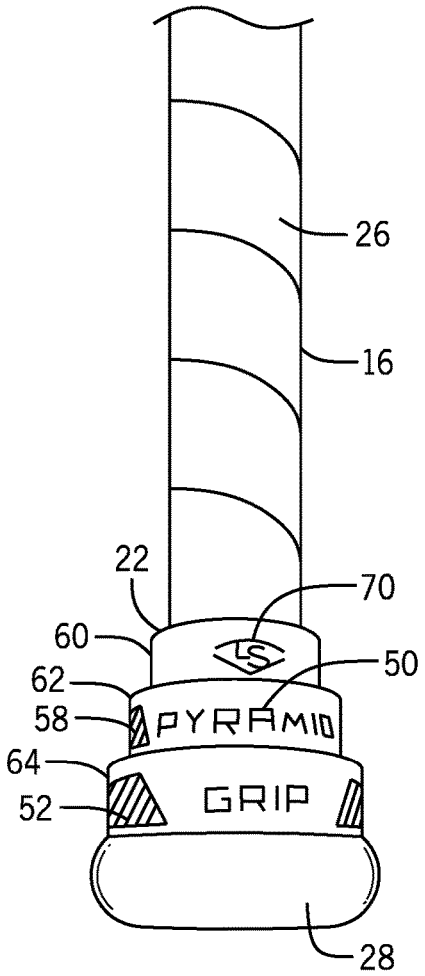
FIG. 2 is an enlarged, side perspective view of a handle portion, a knob and a knob sleeve of the bat of FIG. 1.
Figure 3:
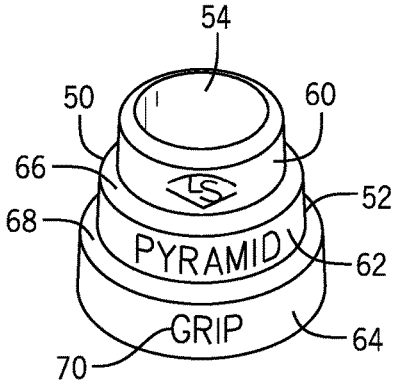
FIG. 3 is a top, side perspective view of the knob sleeve of FIG. 1 shown apart from the bat.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 extending along a longitudinal axis 14.

The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

The frame 12 has a relatively small diameter handle portion 16, a relatively larger diameter barrel portion 18 (also referred as a hitting or impact portion), and an intermediate tapered portion 20. In one implementation, the handle and barrel portions 16 and 18 and the intermediate tapered portion 20 are formed as a single unitary structure. In other implementations, the handle portion, the barrel portion and/or the intermediate tapered portion can be formed as separate structures, which are connected or coupled together. Such a multi-piece frame construction enables each of the three components to be formed of different materials or similar materials to match a particular player's need or application.

The frame 12 is formed of a strong, durable and resilient material, such as, an aluminum alloy. In alternative example implementations, the frame 12 can be formed of one or more fiber composite materials, a titanium alloy, a scandium alloy, steel, other alloys, a thermoplastic material, a thermoset material, wood or combinations thereof. In other alternative implementations, the handle portion 16, the barrel portion 18 and/or the tapered portion 20 can be made of two or three separate materials and/or structures.

As used herein, the terms "composite material" or "fiber composite material" refer to a plurality of fibers impregnated (or permeated throughout) with a resin. In one example embodiment, the fibers can be systematically aligned through the use of one or more creels, and drawn through a die with a resin to produce a pultrusion, as discussed further below. In an alternative example embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly example implementations, the number layers can range from 3 to 8. In other implementations, the number of layers can be greater than 8. In multiple layer constructions, the fibers can be aligned in different directions (or angles) with respect to the longitudinal axis 14 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of example implementations, the resin is preferably a thermosetting resin such as epoxy or polyester resins. In other sets of example implementations, the resin can be a thermoplastic resin. The composite material is typically wrapped about a mandrel and/or a comparable structure (or drawn through a die in pultrusion), and cured under heat and/or pressure. While curing, the resin is configured to flow and fully disperse and impregnate the matrix of fibers.

The handle portion 16 is an elongate tubular structure that extends along the axis 14. The handle portion 16 includes having a proximal end region 22 and a distal end region 24. Preferably, the handle portion 16 is sized for gripping by the user and includes a grip 26, which is wrapped around and extends longitudinally along the handle portion 16, and a knob 28 is connected to the proximal end 22 of the handle portion 16. The distal end region 24 can take a frusto-conical shape or tapered that increases in diameter in a direction along the longitudinal axis 14 and away from the proximal end region 22. In alternative implementations, the handle portion 16 can be formed as a cylindrical structure having a uniform outer diameter along its length.

The barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. Alternatively, other hollow, tubular shapes can also be used. The barrel portion 18 extends along the axis 14 and has an outer surface 34. The barrel portion 18 includes a proximal region 36, a distal region 38 spaced apart by a central region 40.

The bat 10 further includes an end cap 30 attached to the distal region 38 of the barrel portion 18 to substantially enclose the distal region 38. In one example embodiment, the end cap 30 is bonded to the distal region 38 through an epoxy. Alternatively, the end cap can be coupled to the distal region through other adhesives, chemical bonding, thermal bonding, an interference fit, other press-fit connections and combinations thereof.

The intermediate tapered portion 20 connects the handle portion 16 to the barrel portion 18. In one implementation, the intermediate tapered portion 20 includes a frusto-conical shape extending from the distal end region 24 of the handle portion 16 to the proximal region 36 of the barrel portion 18. In another implementation, the bat frame 12 can be formed with only a handle portion connected or coupled to a barrel portion without an intermediate tapered element. In other implementations, the intermediate tapered portion can be can be formed of a single material, or two or more different materials. In one example embodiment, the tapered portion 20 can include of a lightweight, tough durable material, such as engineered thermoplastic polyurethane (ETPU). Alternatively, the tapered portion can be formed of other materials, such as thermoplastic materials, thermoset materials, a composite material, a fiber composite material, aluminum, an alloy, wood, and combinations thereof. In other implementations, the tapered portion 20 can be formed of two or more different materials and/or layers.

Referring to FIGS. 1 through 4, the bat 10 can also include a knob sleeve 50 coupled to the proximal end region 22 of the handle portion 16. The knob sleeve 50 includes a generally tubular body 52 formed of a resilient material such as a silicone rubber having a durometer on the Shore A scale within the range of 30 to 35. In other implementations, the resilient material used to form the tubular body can have durometer on the Shore A scale within the range of 20 to 60. In other implementations, the body 52 of the knob sleeve 50 can be formed of other materials such as other rubbers, natural rubber, other elastomeric materials, a composite material and combinations thereof. The knob sleeve 50 is preferably resilient such that it can be applied to an assembled bat 10 without having to disassembly the knob 28 of the bat 10 or remove any other component of the bat in order to install the knob sleeve 50. In other implementations, the knob sleeve can be formed of a more rigid, less resilient material, such as wood, a plastic, a composite material, acrylonitrile butadiene styrene (ABS), nylon, other polymeric materials, a metal, an alloy and combinations thereof. In one implementation, the body 52 is formed of single, uniform material. In other implementations, the body 52 can be formed of two or more layers of different materials. The knob sleeve 50 can also be formed in one color, or in multi-colored patterns.

The body 52 defines a longitudinally extending bore 54 for receiving the handle portion 16. In one implementation, the bore 54 is sized to receive the handle portion 16 only. The bore 54 extends over at least 50 percent of the length (or height) of the body 52. In another implementation, the bore 54 extends over at least 75 percent of the length of the body 52. In other implementations, the body 52 and the bore 54 are sized to receive and/or extend over the handle assembly 16 and/or the grip 26 of the bat 10. In one implementation, the body 52 also defines a knob recess 56 that can be continuous with the bore 54 but sized to receive and engage at least a portion of the knob 28 of the bat 10. The knob recess 56 has a larger diameter than the bore 54 and is tapered and/or curved to correspond to the shape of a distal surface of the knob 28. In other implementations, the body 52 can be formed without a knob recess 56 and the bore 54 can extend the entire length (or height) of the knob sleeve 50.

The body 52 has an outer surface 58 that is stepped or staggered to define at least first and second gripping regions 60 and 62. In the implementation of FIGS. 1-4, the body 52 includes first, second and third gripping regions 60, 62 and 64. The wall thickness of the body 52 varies from one gripping region to the next. As a result, the outer surface of the body 58 and each of the first, second and third gripping regions 60, 62 and 64 defines first, second and third maximum outside diameters, respectively. The second maximum outside diameter of the second gripping region 62 is greater than the first maximum outside diamenter of the first gripping region 60. Additionally, the maximum outside diameter of the third gripping region 64 of the third gripping region 64 is greater than the first maximum outside diameter and greater than the second maximum outside diameter. In other implementations, the outer surface of the body can be formed to include four or more gripping regions.

The shape of the outer surface 58 of the body 52 of the knob sleeve 50 allows for a gradual transition from the outer diameter of the handle assembly 16 and/or the grip 26 to the outer diameter of the knob 28. The stepped or staggered configuration of the gripping regions 60, 62 and 64 enables a player to move his or her finger or fingers up and down the bat 10, while gripping the bat 10, and maintain the desired feel of a bearing surface of stop contacting or bearing against the finger closest to the knob 28. The knob sleeve 50 enables a player to "choke-up" on the bat in one, two or more different choked-up positions and provides the player with an improved gripping surface and/or bearing surface that simulate the bearing surface provided by the distal surface of the knob 28. As such, by moving his or her hands further up the handle portion 16 of the bat 10 and further up the knob sleeve 50, the player effectively adjusts the effective length and the swing weight and swing moment of inertia (MOI) of the bat 10.

The height or length of each of the gripping regions 60, 62 and 64 (or steps) is sized to accommodate the width of the players fingers. In one implementation, the height or length of each of the gripping regions 60, 62 and 64 is at least 0.4 inch when measured with respect to the longitudinal axis 14. In one implementation, the height or length of each of the gripping regions 60, 62 and 64 can be approximately 0.5 inch when measured with respect to the longitudinal axis 14. In other implementations, the height or length of the gripping regions 60, 62 and/or 64 can be within the range of 0.25 inch to 1.5 inches. In other implementations, the height of the gripping regions 60, 62 and 64 can be within the range of 0.4 to 1.0 inch. In one implementation, such as the implementation of FIGS. 1 through 4, the height or length of the gripping regions 60, 62 and 64 can be substantially equal. In other implementations, one or more of the gripping regions 60, 62 and 64 can have a length that is greater than one or both of the other gripping regions. In one implementation, the collective height of the first, second and third gripping regions 60, 62 and 64 can be at least 1.25 inches.

Figure 4:
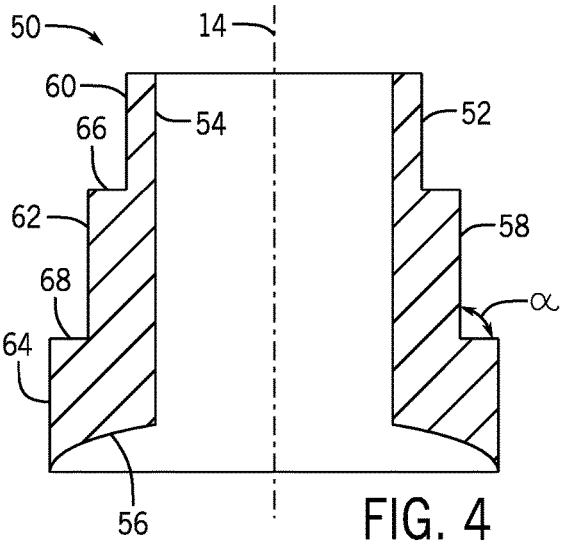
FIG. 4 is a longitudinal cross-sectional view of the knob sleeve of FIG. 3.

The change in average outside diameter of the outer surface of the first and second gripping regions 60 and 62 forms a first bearing surface 66, and the change in average outside diameter of the outer surface of the second and third gripping regions 62 and 64 forms a second bearing surface 68. The bearing surface 66 and 68 provide surfaces that are configured to engage or bear against the side of one or two fingers of the player while gripping the bat 10, when the player grips the bat at the first, second and/or third gripping regions 60, 62 and 64. The first and second bearing surface 66 and 68 can include slightly curved to rounded corners between the gripping regions 60, 62 and 64. In other implementations the first and second bearing surface 66 and 68 can form sharper or more squared off corners between the gripping regions 60, 62 and 64. The bearing surfaces 66 and 68 are generally perpendicular to the outside surfaces of the gripping regions 60, 62, and 64. Referring to FIG. 4, angle $\alpha$ is representative of the angles defined by first and second gripping surfaces 66 and 68 and the outer surface of the first, second and third gripping regions 60, 62 and 64. In other implementations, the first and second bearing surface 66 and 68 can be curved, sloped and/or shaped with respect to the outer surface of the gripping regions 60, 62 and 64 to provide angled or curved angled surfaces, such that the angle $\alpha$ can be within the range of 60 to 120 degrees. In one implementation, the first and second bearing surfaces 66 and 68 are sized to extend in a direction radially outward from the axis 14 between the outer surfaces of the respective first, second and third gripping regions 60, 62 and 64 by a dimension of approximately 0.100 inch. The bearing surfaces 66 and 68 provide the stepped or staggered configurations between the first, second and third gripping regions 60, 62 and 64. In other implementations, the first and second bearing surfaces 66 and 68 can radially extend outward between the outer surfaces of two of the respective first, second and third gripping regions by a dimension within the range of 0.070 to 0.300 inch.

In one implementation, the outer surface 58 of the body 52 of the knob sleeve 50 includes alphanumeric and/or graphical indicia 70. The indicia 70 can take the form of one or more designs, trademarks, graphics, specifications, certifications, instructions, warnings and/or markings. The indicia 70 can be molded formed into the outer surface 58 of the body 52. In other implementations, the indicia 70 can be formed, attached or applied to the outer surface 58 of the body 50 by use of adhesives, embossing, screening, branding, engraving, other conventional means, and combinations thereof.

Figure 5:
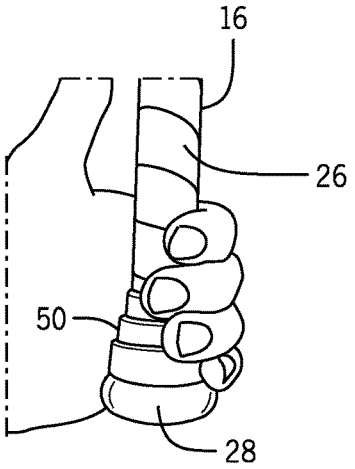
FIG. 5 is a side view of the handle portion, the knob and the knob sleeve of FIG. 1 shown with a player's hand grasping the handle portion, the knob and the knob sleeve in a traditional manner.

Referring to FIGS. 5 through 10, six example gripping positions of a player's hand on the handle assembly 16 with the knob sleeve 50 are shown. FIGS. 5 through 10 are examples of the flexibility the knob sleeve 50 provides to the player while gripping the bat 10 during a game, during an at-bat, and even between pitches of an at-bat. FIG. 5 illustrates a player's left hand gripping the proximal end 22 of the handle portion 16, the knob sleeve 50 and the knob 28 in a traditional bat grip position. In the traditional bat grip position, the player's pinky finger rests on the distal surface of the knob 28 and extends over the third gripping region 64 of the knob sleeve 50, the ring finger of the player extends over and/or around at least a portion of the second gripping region 62, and the player's middle finger extends over and/or around at least a portion of the first gripping region 60. The player's index finger and the player's other hand would grip the grip 26 of the handle portion 16. In the traditional bat grip position the pinky finger has the traditional engagement with or bears against the distal surface of the knob 28. With the knob sleeve 52, the ring finger and the middle finger of the player receive the additional comfort and/or feel of the first and second gripping regions 60 and 62 and the first and second bearing surfaces 66 and 68.

Figure 6:
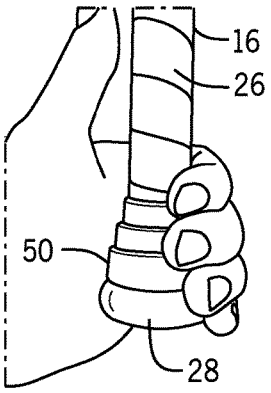
FIG. 6 is a side view of the handle portion, the knob and the knob sleeve of FIG. 1 shown with a player's hand grasping the handle portion, the knob and the knob sleeve in a "one finger drop" manner, with the player's hand positioned slightly lower on the bat than the traditional manner of FIG. 5 and with one finger of the player positioned below the knob.

FIG. 6 illustrates the player gripping the bat 10 in a one-finger drop manner. In the one-finger drop manner, the player's pinky finger extends around the knob 28 of the bat, the player's ring finger, middle finger and index finger extends over and at least partially around the third, second and first gripping regions 64, 62 and 60, respectively. In the one-finger drop grip position, the index finger, the middle finger and the ring finger receive the additional comfort and/or feel of the first, second and third gripping regions 60, 62 and 64, respectively, and the first and second bearing surfaces 66 and 68.

Figure 7:
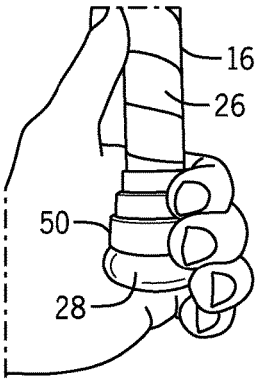
FIG. 7 is a side view of the handle portion, the knob and the knob sleeve of FIG. 1 shown with a player's hand grasping the handle portion, the knob and the knob sleeve in a "two finger drop" manner, with the player's hand positioned slightly lower on the bat than the traditional manner of FIG. 5 and the one-finger drop manner of FIG. 6. and with one finger of the player positioned below the knob.

FIG. 7 illustrates the player gripping the bat 10 in a two-fingers dropped manner. In the two-fingers dropped manner, the player's pinky finger extends beneath the knob 28 and essentially off of the proximal end of the bat 10, the ring finger extends around the knob 28 of the bat, and the player's middle finger and index finger extend over and at least partially around the third and second gripping regions 64 and 62, respectively. In the two-fingers dropped grip position, the index finger and the middle finger receive the additional comfort and/or feel of the second and third gripping regions 62 and 64, respectively, and the second bearing surface 68.

Figure 8:
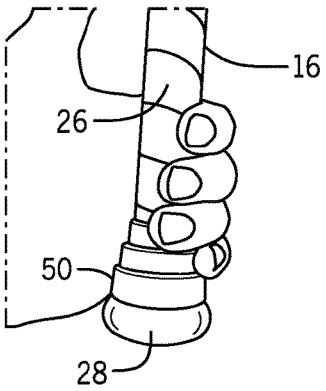
FIG. 8 is a side view of the handle portion, the knob and the knob sleeve of FIG. 1 shown with a player's hand grasping the handle portion, the knob and the knob sleeve in a "first choked-up" manner, with the player's hand positioned slightly higher on the bat than the traditional manner of FIG. 5.
Figure 9:
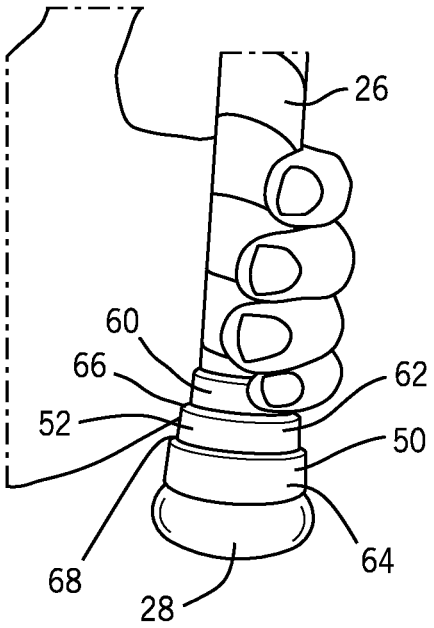
FIG. 9 is a side view of the handle portion, the knob and the knob sleeve of FIG. 1 shown with a player's hand grasping the handle portion, the knob and the knob sleeve in a "second choked-up" manner, with the player's hand positioned slightly higher on the bat than the traditional manner of FIG. 5 and the first choked-up manner of FIG. 8.
Figure 10:
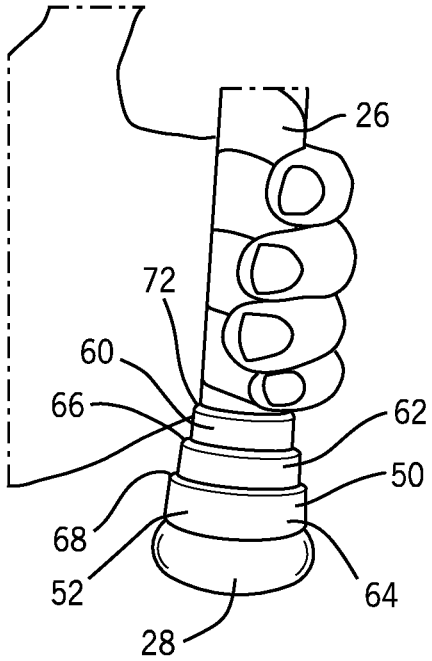
FIG. 10 is a side view of the handle portion, the knob and the knob sleeve of FIG. 1 shown with a player's hand grasping the handle portion, the knob and the knob sleeve in a "third choked-up" manner, with the player's hand positioned slightly higher on the bat than the traditional manner of FIG. 5, the first choked-up manner of FIG. 8, and the second choked-up manner of FIG. 9.

Referring to FIGS. 8, 9 and 10, first, second and third choked-up grip positions are illustrated. In one implementation, the player's hand is choked-up by approximately 0.5 inch, 1.0 inch and 1.5 inches while in the first, second and third choked-up grip positions, respectively. In other implementations, the player's hand may be choked-up by other dimensions depending upon the length and/or height of the first, second and third gripping regions 60, 62 and 64. In the first choked-up grip position as shown in FIG. 8, the player's pinky finger rests on the second gripping region 62 and the player's ring finger extends over and at least partially around the first gripping region 60. The player receives the benefit of his or her pinky finger engaging and/or bearing against the second bearing surface 68 and the ring finger engaging and/or bearing against the first bearing surface 66. In the second choked-up grip position as shown in FIG. 9, the player's pinky finger extends over and/or at least partially around the first gripping region 60 and also bears against the first bearing surface 66. In the third choked-up position as shown in FIG. 10, the player's pinky finger and the player's lower hand is positioned entirely above the knob sleeve 50 with the player's pinky finger bearing against a distal bearing surface 72 of the body 52 of the knob sleeve 50. When a player grips the handle portion 16 of the bat 10 and the knob sleeve 50, such as in one of the grip positions illustrated in FIG. 8, 9 or 10, the knob sleeve 30 provides the advantages of absorbing vibrational energy, and reducing stresses and loads on the player's hand and/or wrist during a swing of the bat 10 and during impact of the bat 10 with a ball. The a resilient elastomeric construction of the knob sleeve 50 absorbs energy and dampens vibration. During practice and play, players typically perform a significant number of swings including swings that impact a ball. These swings and/or impacts create vibrational energy and bending loads that are transferred at least in part to the player's hands and/or wrists, particularly the hand and/or wrist positioned closer to the knob 28 of the bat 10. Overtime, many players can experience pain, fatigue or even injury from repeated swings, impacts and loads applied to the user's lower hand and/or wrist. The resilient elastomeric knob sleeve 50 serves to mitigate, reduce and/or absorb the some of these loads thereby allowing the player to swing freer and easier.

FIGS. 5 through 10 illustrate only example gripping positions a player could use with the knob sleeve 50 applied to the bat 10. Other gripping positions can also be used by the player. The example gripping positions illustrated in FIGS. 5 through 10 illustrate the versatility and added comfort and/or feel a player can receive from the knob sleeve 50 is used on the bat 10.

Figure 11:
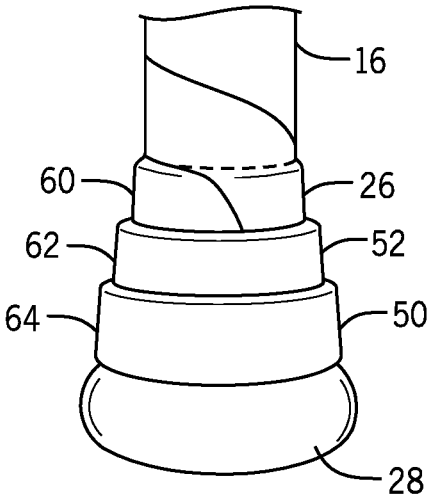
FIG. 11 is an enlarged, side perspective view of a handle portion, a knob and a knob sleeve of the bat in accordance with an another example implementation of the present invention.

Referring to FIG. 11, in another implementation, the knob sleeve 50 can be positioned over the handle portion 16 of the bat 10 and the grip 26 can be applied so as to extend over at least a portion of the knob sleeve 50. In FIG. 11, the grip 26 is shown applied over only the first gripping region 60 of the body 52 of the knob sleeve 50. In other implementations, the grip 26 can be applied to the bat so as to extend over the first, second and/or third gripping regions 60, 62 and 64 or any portion thereof.

Figure 12:
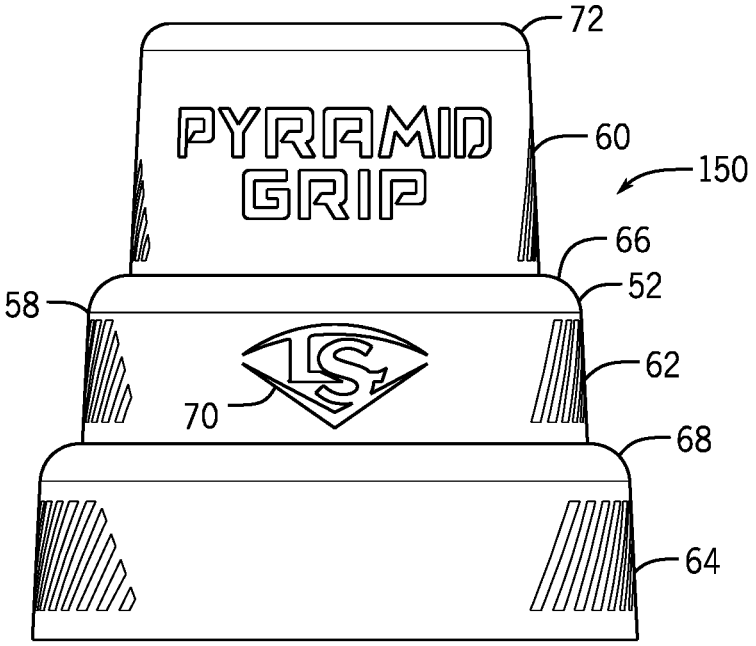
FIG. 12 is a side view of a knob sleeve in accordance with another example implementation of the present invention.

Referring to FIG. 12, an alternative implementation of the present invention is illustrated. In this alternate implementation, a knob sleeve 150 is shown. Knob sleeve 150 is substantially the same as knob sleeve 50 except that the height or length of the first gripping region 60 is greater than the length of the second and third gripping regions 62 and 64. In one implementation, the first gripping region 60 can have a height of approximately 1.0 inch, and the second and third gripping regions 62 and 64 can have a height of approximately 0.5 inch. In other implementations, other lengths for the first, second and third gripping regions 60, 62 and 64 can be used. In other implementations, the lengths of the first, second and third gripping regions 60, 62, 64 can be the same or one or more of the lengths of the gripping regions can be different from the other gripping regions. In still other implementations, the size or radial dimension of the first and second bearing surfaces 66 and 68 can also be substantially equal or varied from each other.

Figure 13:
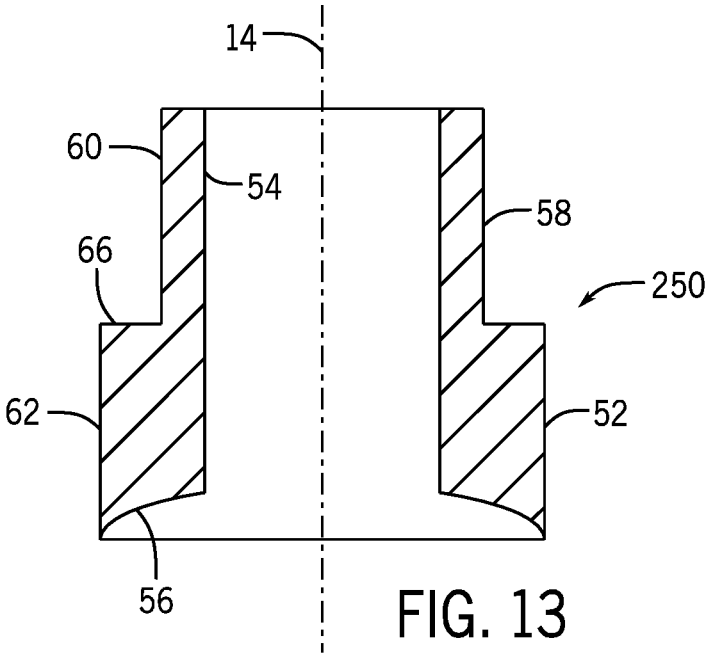
FIG. 13 is a longitudinal cross-sectional view of a knob sleeve in accordance with another example implementation of the present invention.
Figure 14:
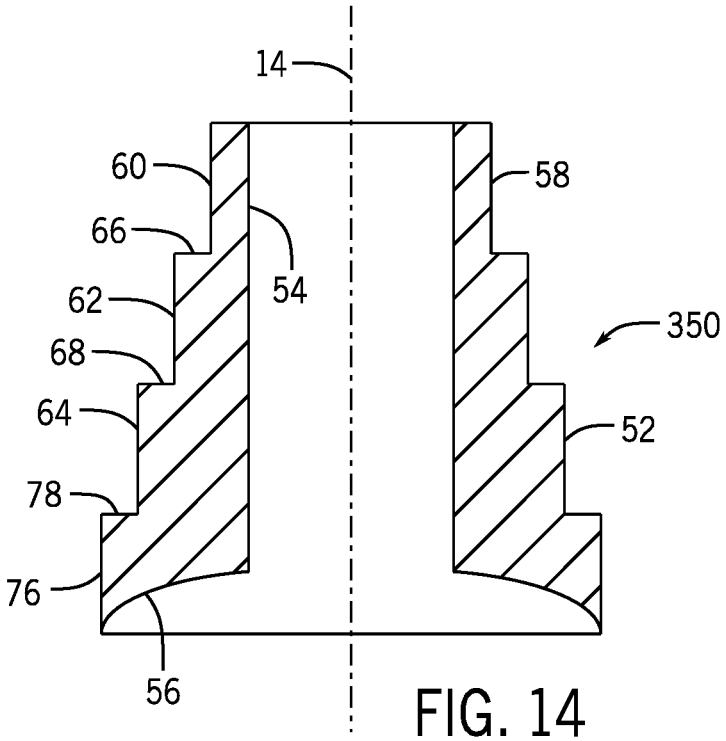
FIG. 14 is a longitudinal cross-sectional view of a knob sleeve in accordance with another example implementation of the present invention.

Referring to FIGS. 13 and 14, other alternative implementations of the present invention are illustrated. In these alternate implementations of FIGS. 13 and 14, knob sleeves 250 and 350 are shown as including only first and second gripping regions 60 and 62, and as including first, second, third and fourth gripping regions 60, 62, 64 and 76, respectively. The knob sleeves 250 and 350 are substantially the same as the knob sleeve 50 and 150 except for the number of gripping regions, and the dimensions of the gripping regions and bearing surfaces. The knob sleeve 350 includes a third bearing surface 78 positioned between the third and fourth gripping regions 64 and 76. In other implementations, the knob sleeve can have five or more gripping regions. In one implementation, the body 50 of the knob sleeve 50, 150, 250 or 350 can have a maximum outside diameter that is no greater than the maximum outside diameter of the knob 28. In another implementation, the body 50 of the knob sleeve 50, 150, 250 or 350 can have a maximum outside diameter that is no greater than a dimension that 0.5 inches less than the maximum outside diameter of the knob 28.

Figure 15:
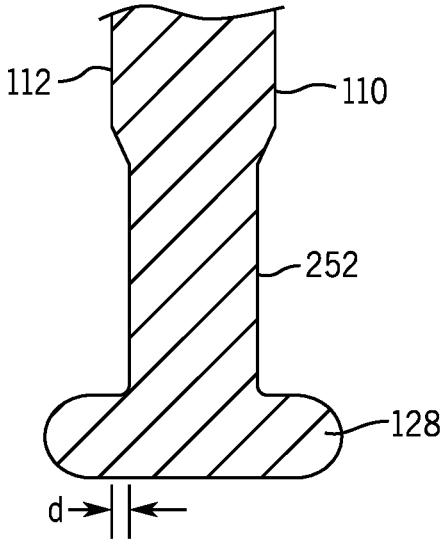
FIG. 15 is a side view of a handle portion of a ball bat in accordance with another example implementation of the present invention.
Figure 16:
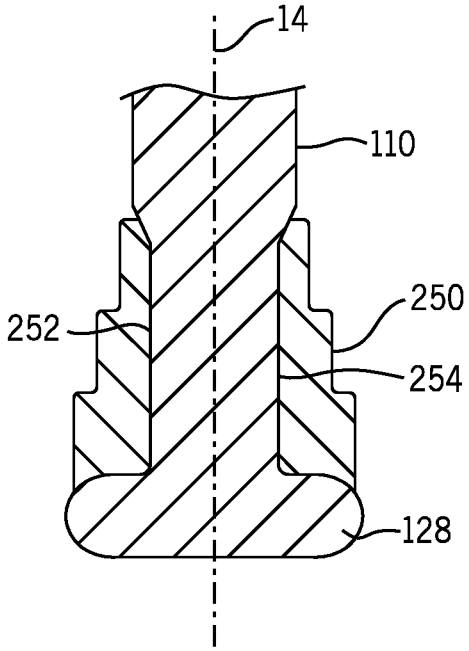
FIG. 16 is a longitudinal cross-sectional view of a ball bat handle assembly including the bat of FIG. 15 and a knob sleeve in accordance with another example implementation of the present invention.

Referring to FIGS. 15 and 16 an alternative implementation of a ball bat 110 is illustrated, and an alternative implementation of a handle assembly including a knob sleeve 250 is illustrated. The ball bat 110 is substantially similar to the ball bat 10 except that the handle portion 112 of the bat 110 includes a knob sleeve recess 252 for receiving and retaining the knob sleeve 250. In one implementation, the bat 110 can be formed of wood. In other implementations, the bat 110 can be formed of other materials, such as aluminum, titanium, other alloys, a fiber composite material, and combinations thereof.

The knob sleeve recess 252 can be an annular recess extending about the handle portion 112 adjacent a knob 128 of the bat 110. The knob recess 252 can have a radial depth, d, within the range of 0.005 to 0.250 inch. The ends of the knob recess 252 can be curved or sloped as shown in FIG. 15. In other implementations, one or more of the ends of the knob recess 252 can be formed with a sharper transition from the recess 252 to the adjacent region of the handle portion 112.

The knob sleeve 250 is can be substantially the same as the knob sleeves 50 or 150. In one implementation, the knob sleeve 250 can have a thicker radial dimension measured radially from the longitudinal axis 14 than the knob sleeves 50 or 150. The knob sleeve 250 is configured to fixedly or removably engage the handle portion 112 at the knob sleeve recess 252. The knob sleeve 250 includes an inner bore 254 for engaging the knob sleeve recess 252. In one implementation, the length of the knob sleeve 250 is substantially the same as the length of the knob sleeve recess 252. In another implementation, the length of the knob sleeve 250 can be slightly less than the length of the knob sleeve recess 252. The knob sleeve 250 can have an increased radial thickness to allow for the knob sleeve 250 to fully fill the depth of the knob sleeve recess 252, and to extend radially outward from the knob sleeve recess 252 so as to achieve the same profile as that of the knob sleeve 50 or the knob sleeve 150. The knob sleeve 250 can take a shape of any of the above-references implementations.

While the example implementations of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific implementations of the present invention.

What is claimed is:

1. A knob sleeve for a ball bat extending along a longitudinal axis and having a tubular handle portion and a knob attached to the handle portion, the knob sleeve comprising:

a tubular body having a distal end and a proximal end, the body defining a central bore for receiving the handle portion, the body including at least first and second regions positioned adjacent the distal and proximal ends of the body, respectively, the first and second regions having first and second maximum outside diameters, respectively, the second maximum outside diameter being greater than the first maximum outside diameter, each of the first and second regions having a height measured with respect to the longitudinal axis of at least 0.4 inch, a first bearing surface positioned between the first and second regions, at least a portion of the first bearing surface being generally perpendicular to the longitudinal axis.

2. The knob sleeve of claim 1, wherein the knob sleeve has an outer surface, and wherein the outer surface includes alphanumeric and/or graphical indicia, and wherein the portion of the first bearing surface is generally perpendicular to the outer surface of at least one of the first and second regions.

3. The knob sleeve of claim 1, wherein the body further defines a knob recess continuous with the central bore, the knob recess configured for receiving a portion of the knob.

4. The knob sleeve of claim 1, wherein the at least first and second regions is at least first, second and third regions, wherein the second region longitudinally spaces apart the first and third regions, wherein the third region has a third outer surface, wherein a second bearing surface is positioned between the second and third regions, and wherein at least a portion of the second bearing surface is generally perpendicular to longitudinal axis.

5. The knob sleeve of claim 1, wherein the at least first and second regions is at least first, second, third and fourth regions, and wherein the second and third regions longitudinally space apart the first and fourth regions.

6. The knob sleeve of claim 1, wherein the body is formed of a resilient material and wherein the knob sleeve is removably attachable to the handle assembly of the bat by resiliently extending over the knob and a proximal region of the handle assembly.

7. The knob sleeve of claim 4, wherein the third region includes a third maximum diameter, and wherein the third maximum diameter is greater than the second maximum diameter.

8. The knob sleeve of claim 4 wherein the collective height of the first, second and third regions is at least 1.25 inches.

9. The knob sleeve of claim 4, wherein the knob sleeve has an outer surface, and wherein the outer surface includes alphanumeric and/or graphical indicia.

10. The knob sleeve of claim 1, wherein the first and second regions having first and second outer surfaces, respectively, and wherein the portion of the first bearing surface is generally perpendicular to at least one of the first and second outer surfaces.

11. A ball bat for gripping by the hands of a player, the ball bat extending along a longitudinal axis and comprising:

a barrel portion;

a handle portion including a proximal region, the handle portion coupled to the barrel portion;

a knob coupled to the proximal region of the handle portion; and a knob sleeve coupled to the handle portion, the knob sleeve including a unitary tubular body having a distal end and a proximal end, the body defining a central bore for receiving the handle portion, the body including at least first, second and third regions, the first and third regions positioned adjacent the distal and proximal ends of the body, respectively, the second region longitudinally spacing apart the first and third regions, the first, second and third regions having first, second and third maximum outside diameters, respectively, the second maximum outside diameter being greater than the first maximum outside diameter, and the third maximum outside diameter being greater than the second maximum outside diameter, a first bearing surface positioned between the first and second regions and a second bearing surface positioned between the second and third regions, at least a portion of at least one of the first and second bearing surfaces being generally perpendicular to the longitudinal axis.

12. The ball bat of claim 11, further comprising a grip positioned over at least a portion of the handle portion, wherein the knob sleeve resiliently extends over a portion of the grip.

13. The ball bat of claim 11, further comprising a grip positioned over at least a portion of the handle portion, wherein at least a portion of grip extends over at least the first region of the body of the knob sleeve.

14. The ball bat of claim 11, wherein the outer surface includes alphanumeric and/or graphical indicia, and wherein at least a portion of the first bearing surface is generally perpendicular to the longitudinal axis.

15. The ball bat of claim 11, wherein the body further defines a knob recess continuous with the central bore, and wherein the knob recess configured for receiving a portion of the knob.

16. The ball bat of claim 11, wherein each of the first, second and third regions have a height measured with respect to the longitudinal axis of at least 0.4 inch and wherein at least a portion of the second bearing surface is generally perpendicular to the longitudinal axis.

17. The ball bat of claim 11, wherein the knob sleeve is removably attachable to the handle portion of the ball bat by resiliently extending over the knob and the proximal region of the handle portion.

18. The ball bat of claim 11, wherein the handle portion, the knob sleeve and the knob define at least three discrete ball bat gripping positions for the hands of the player.

19. The ball bat of claim 11, wherein the handle portion, the knob sleeve and the knob define at least four discrete ball bat gripping positions for the hands of the player.

20. The ball bat of claim 11, wherein a knob sleeve recess for receiving the knob sleeve is formed in the handle portion.

21. The ball bat of claim 20, wherein the knob sleeve recess has a radial depth within the range of 0.005 to 0.250 inch.

22. The ball bat of claim 11, wherein the knob sleeve is formed of a material having a durometer on the Shore A scale within the range of 20 to 60.

23. The ball bat of claim 11, wherein the first, second and third regions having first, second and third outer surfaces, respectively, wherein the portion of the first bearing surface is generally perpendicular to the first and second outer surfaces, and wherein the portion of the second bearing surface is generally perpendicular to the second and third outer surfaces.

* * * * *